United States Patent [19]

Kusui et al.

[11] Patent Number: 4,959,195

[45] Date of Patent: Sep. 25, 1990

[54] METHOD OF FORMING LARGE-SIZED ALUMINUM ALLOY PRODUCT

[75] Inventors: Jun Kusui, Yokaichi; Masahiko Kawai, Nara; Yusuke Odani, Higashioska; Yoshinobu Takeda, Suita, all of Japan

[73] Assignees: Sumitomo Electric Industries, Ltd.; Toyo Aluminium Kabushiki Kaisha, both of Japan

[21] Appl. No.: 347,879

[22] Filed: May 4, 1989

[30] Foreign Application Priority Data

May 12, 1988 [JP] Japan ..... 63-115625

[51] Int. Cl.[5] ..... B22F 1/00

[52] U.S. Cl. ..... 419/67; 419/41; 148/11.5 A

[58] Field of Search ..... 419/41, 67; 148/11.5 A

[56] References Cited

U.S. PATENT DOCUMENTS

| | | | |
|---|---|---|---|
| 2,978,798 | 4/1961 | Wassermann et al. | 29/182.5 |
| 4,297,136 | 10/1981 | Pickens et al. | 75/235 |
| 4,702,885 | 10/1987 | Odani et al. | 419/23 |
| 4,722,751 | 2/1988 | Akechi et al. | 419/32 |
| 4,743,317 | 5/1988 | Skinner et al. | 419/66 |

FOREIGN PATENT DOCUMENTS

| | | |
|---|---|---|
| 0100470 | 2/1984 | European Pat. Off. . |
| 0144898 | 6/1985 | European Pat. Off. . |
| 0180144 | 5/1986 | European Pat. Off. . |
| 0265307 | 4/1988 | European Pat. Off. . |
| 912959 | 12/1962 | United Kingdom . |
| 2167442 | 5/1986 | United Kingdom . |

OTHER PUBLICATIONS

Patent Abstracts of Japan, vol. 12, No. 40 (C-474) [2887], published on Feb. 5, 1988.

*Primary Examiner*—Stephen J. Lechert, Jr.
*Attorney, Agent, or Firm*—Timothy R. Kroboth

[57] ABSTRACT

The invention provides a process for preparing a large-sized P/M aluminum alloy product comprising:

extruding at a temperature between 350° and 500° C. and at an extrusion ratio of 2 to 10, aluminum alloy powder consisting essentially of (a) 5 to 30% by weight of Si, (b) 0.5 to 10% by weight of at least one species selected from the group consisting of Cu, Mg, Fe, Ni, Cr, Mn, Mo, Zr and V with the proviso that the total amount of these species cannot exceed 30% by weight, and (c) aluminum in a remaining amount.

7 Claims, 1 Drawing Sheet

METHOD OF FORMING LARGE-SIZED ALUMINUM ALLOY PRODUCT

FIELD OF THE INVENTION

The present invention relates to a method of forming aluminum alloy product.

BACKGROUND OF THE INVENTION

Products of aluminum alloy prepared by powder metallurgy process (hereinafter referred to as "P/M process") exhibit highly improved heat resistance, wear resistance, and like properties in comparison with the products prepared by ingot metallurgy process (hereinafter referred to as "IM process") because the products by P/M process can contain additional elements in larger amounts with no segregation and much more uniformly dispersed in aluminum matrix than the products prepared by IM process.

Conventional P/M aluminum alloy products are usually produced by extruding a powdery, flaky or ribbon-like material to obtain a billet and processing the billet to the desired shapes or forms. During the hot extrusion step, the oxide films on the surfaces of powder particles, flakes or ribbons are fractured and the exposed inner aluminum portions are pressed each other to form strong bonding. In powder-rolling process and powder-forging process which also belong to a general category of P/M process, aluminum oxide films are fractured; however, since shearing force is relatively small and deformation of each particle is not so large and uniform as in the case of extrusion, the bond between particles is not so strong as in the extruded product.

The extrusion ratio in conducting the above extrusion by P/M process is usually 10 or more, preferably 20 or more to obtain a strong bonding of each particle. The extrusion by P/M process usually requires much higher forces than the extrusion by IM process because the aluminum alloy used in the former process contain larger amounts of alloying elements. For these limitations, aluminum alloy materials obtained by P/M process are difficult to employ for producing large-sized products.

SUMMARY OF THE INVENTION

The primary object of the invention is to provide a process capable of preparing by extruding a large-sized product of P/M aluminum alloy with a diameter of 150 mm or more.

Another object of the invention is to provide a process capable of carrying out the extrusion of P/M aluminum alloy under a low extrusion ratio of 10 or lower.

Still another object of the invention is to provide a process capable of producing a strong product by extrusion of P/M aluminum alloy even under an extremely low extrusion ratio of 2 to 5.

Other objects and features of the invention will become apparent from the following description.

The present invention provides:

a process for preparing a large-sized P/M aluminum alloy product comprising:

extruding, at a temperature between 350 and 500° C. and at an extrusion ratio of 2 to 10, an aluminum alloy powder consisting essentially of (a) 5 to 30% by weight of Si, (b) 0.5 to 10% by weight of at least one species selected from the group consisting of Cu, Mg, Fe, Ni, Cr, Mn, Mo, Zr and V with the proviso that the total amount of these species cannot exceed 30% by weight, and (c) aluminum in a remaining amount.

We conducted extensive research to obviate the prior art problems as mentioned above and found that these problems can be markedly alleviated by use of powdery aluminum alloy comprising specific alloying elements. The present invention has been accomplished on the basis of this novel finding.

DETAILED DESCRIPTION OF THE INVENTION

The aluminum alloys used in the invention are in a powdery form and contain as alloying elements (a) 5 to 30% by weight of Si and (b) 0.5 to 10% by weight of at least one species selected from the group consisting of Cu, Mg, Fe, Ni, Cr, Mn, Mo, Zr and V with the proviso that the total amount of these species cannot exceed 30% by weight. When the aluminum alloys of the invention with the above specific components are extruded, the powder particles are strongly bonded each other even at a low extrusion ratio and the extruded material exhibits substantially uniform strength and elongation irrespective of the extrusion ratio. If an aluminum alloy powder with the composition outside the above specified range is used, an extruded material with strong bonding cannot be obtained at a low extrusion ratio of 10 or less at a temperature of 350 to 500° C.

Stated more specifically, if the amount of Si is less than 5% by weight of the alloy, the bonding strength of the particles is low; whereas the use of Si of more than 30% by weight results in the excess volume of primary Si particles in the matrix which leads to a reduction in the toughness of the alloy. Preferably, the amount of Si is 10 to 14% by weight of the alloy.

The amount of Cu, Mg, Fe, Ni, Cr, Mn, Mo, Zr and V in less than 0.5% by weight results in inferior heat resistance and strength of the extruded material whereas the amount thereof in more than 10% by weight results in lower toughness with the formation of intermetallic compounds. The total amount of these alloying elements in excess of 30% by weight also leads to a reduction of toughness of the alloy.

The aluminum alloy powder of the invention preferably contains 3 to 5% by weight of Fe, 3 to 5% by weight of Ni; 0.5 to 2.5% by weight of Mo and 0.5 to 2.5% by weight of Zr, the total amount of Mo and Zr being 2 to 5% by weight. With use of the aluminum alloy of the preferable composition, an excellent strength of extruded material at elevated temperatures of up to about 300° C. and a high critical upset reduction are achieved.

The extruded material prepared according to the invention using an aluminum alloy powder of specified composition has a high critical upset reduction of up to 60 or 70% irrespective of extrusion ratio. The extruded material of the invention can be upset forged in the radial directions with an upset reduction of 30 to 80% at 400° to 530° C. When an aluminum alloy having a composition outside the specified range of the invention is used, a billet produced at a low extrusion ratio of 2 to 5 does not show good forgeability and cannot be upset forged at a temperature between 400° and 530° C. to a upset reduction of 30 to 80%.

Figure 1:
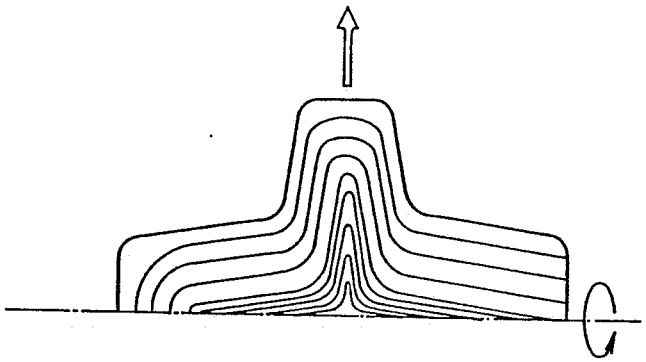
FIG. 1 is a schematic cross section showing the relationship between the direction of the highest centrifugal force and the flow direction of powdery material during the extrusion.
Figure 2:
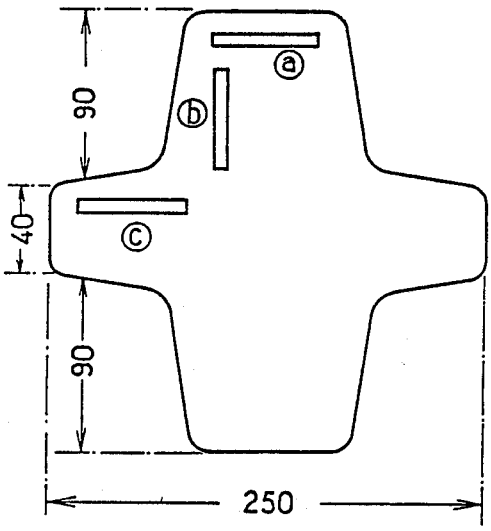
FIG. 2 is a schematic side view showing the shape of the extruded and die-forged product obtained in Example 4 of the invention.

The extruded material prepared according to the invention can be further die-forged to a shape as indicated in FIG. 2 which has an enlarged diameter more than 1.5 times the initial diameter of the extruded material. The forged product thus obtained is free from internal defects and has a theoretical density of 100%. When the forged product produced in this manner is used as a rotating part, the direction indicated with the arrow in FIG. 1 (the direction of centrifugal force) coincides with the flow direction of the alloy powder during the extrusion (the direction of the highest strength) with the most favorable result.

According to the invention using an aluminum alloy of a specific composition, a very strong bond can be produced in an extruded material at a low extrusion ratio of 10 or less, or even at a very low extrusion ratio of 2 to 5.

When the extruded material of the invention is further upset forged under a heated condition, products with a large diameter such as a large rotar rotating at a high speed at an elevated temperature and the like can be obtained.

EXAMPLES

Given below are Examples to clarify the features of the invention in greater detail.

EXAMPLE 1

Aluminum alloys containing alloying elements as indicated Table 1 below were air-atomized into particles and sieved to prepare powders of minus 100 mesh.

TABLE 1

| | Alloying Elements (wt. %) | | | | | | | | | |
|---|---|---|---|---|---|---|---|---|---|---|
| No. | Cu | Si | Fe | Ni | Cr | Mn | Mo | Zr | V | Mg |
| 1 | | 12 | | | | 8 | | | 1 | |
| 2 | | 12 | | 8 | | | 1 | | | |
| 3 | | 15 | 5 | 3 | | | | | | |
| 4 | | 15 | | 3 | 3 | | | | | |
| 5 | 4 | 20 | | | 4 | | | | | |
| 6 | | 20 | 5 | | | | | 1 | | |
| 7 | | 25 | 3 | 5 | | | 1 | | | |
| 8 | | | 7 | | 2 | | | 1.5 | | |
| 9 | 5 | | 2 | 5 | | | | | | 3 |
| 10 | 1.5 | | | 1.5 | 3 | 1.5 | | 1.5 | | |
| 11 | | 12 | 4 | 4 | | | 2 | 0.5 | | |
| 12 | | 12 | 4 | 4 | | | 1.5 | 1 | | |
| 13 | | 12 | 4 | 4 | | | 2 | 1.5 | | |
| 14 | | 12 | 5 | | | | | | | 2 |
| 15 | | 3 | 8 | 2 | | | | | | |
| 16 | | 35 | 5 | | | 3 | | | | |

Each of the aluminum alloy powders thus prepared was cold pressed to a preform 30 mm in diameter and 80 mm in height and then extruded at 450° C. at varying extrusion ratios. Test pieces were prepared from the extruded materials, and tensile tests were conducted at room temperature and at 300° C. respectively.

Tensile strength and elongation at room temperature are given in Table 2-A (extrusion ratio = 3:1), Table 2-B (extrusion ratio =5:1) and Table 2-C (extrusion ratio =20:1).

Tensile strength and elongation at 300° C. are given in Table 3-A (extrusion ratio = 3:1), Table 3-B (extrusion ratio = 5:1) and Table 3-C (extrusion ratio = 20:1).

TABLE 2-A

| No. | Tensile strength ($kg/mm^2$) | Elongation (%) |
|---|---|---|
| 1 | 42.5 | 2.4 |
| 2 | 44.2 | 2.2 |
| 3 | 43.3 | 1.9 |
| 4 | 43.3 | 0.4 |
| 5 | 48.5 | 0.5 |
| 6 | 45.2 | 0.3 |
| 7 | 43.9 | 0.3 |
| 8 | 44.2 | 1.4 |
| 9 | 38.9 | 0.2 |
| 10 | 40.3 | 1.0 |
| 11 | 48.5 | 0.5 |
| 12 | 49.2 | 0.5 |
| 13 | 50.1 | 0.4 |
| 14 | 41.2 | 1.2 |
| 15 | 35.2 | 0.1 |
| 16 | 56.2 | 0.1 |

TABLE 2-B

| No. | Tensile strength ($kg/mm^2$) | Elongation (%) |
|---|---|---|
| 1 | 41.8 | 2.9 |
| 2 | 43.4 | 2.1 |
| 3 | 44.0 | 1.7 |
| 4 | 43.2 | 0.5 |
| 5 | 47.9 | 0.5 |
| 6 | 45.8 | 0.3 |
| 7 | 44.3 | 0.2 |
| 8 | 45.2 | 2.1 |
| 9 | 44.2 | 1.9 |
| 10 | 45.6 | 1.2 |
| 11 | 48.4 | 0.5 |
| 12 | 49.2 | 0.5 |
| 13 | 50.0 | 0.5 |
| 14 | 42.0 | 1.1 |
| 15 | 36.7 | 2.5 |
| 16 | 46.3 | 0.1 |

TABLE 2-C

| No. | Tensile strength ($kg/mm^2$) | Elongation (%) |
|---|---|---|
| 1 | 42.1 | 2.6 |
| 2 | 43.4 | 2.4 |
| 3 | 43.5 | 1.9 |
| 4 | 43.9 | 0.5 |
| 5 | 48.5 | 0.3 |
| 6 | 45.6 | 0.3 |
| 7 | 44.2 | 0.2 |
| 8 | 54.0 | 6.0 |
| 9 | 52.0 | 2.5 |
| 10 | 52.0 | 1.3 |
| 11 | 48.6 | 0.5 |
| 12 | 49.1 | 0.4 |
| 13 | 50.2 | 0.5 |
| 14 | 41.3 | 1.3 |
| 15 | 40.1 | 4.5 |
| 16 | 46.3 | 0.1 |

TABLE 3-A

| No. | Tensile strength ($kg/mm^2$) | Elongation (%) |
|---|---|---|
| 1 | 15.9 | 16.2 |
| 2 | 16.0 | 14.1 |
| 3 | 19.5 | 9.0 |
| 4 | 17.9 | 11.2 |
| 5 | 19.0 | 12.1 |
| 6 | 18.5 | 10.2 |
| 7 | 20.2 | 8.2 |
| 8 | 22.1 | 3.1 |
| 9 | 12.5 | 2.2 |
| 10 | 14.3 | 4.3 |

TABLE 3-A-continued

| No. | Tensile strength (kg/mm²) | Elongation (%) |
|---|---|---|
| 11 | 22.5 | 7.3 |
| 12 | 22.8 | 6.5 |
| 13 | 24.5 | 6.4 |
| 14 | 16.1 | 12.5 |
| 15 | 11.2 | 2.0 |
| 16 | 46.3 | 0.1 |

TABLE 3-B

| No. | Tensile strength (kg/mm²) | Elongation (%) |
|---|---|---|
| 1 | 16.2 | 15.9 |
| 2 | 15.1 | 18.0 |
| 3 | 19.3 | 9.2 |
| 4 | 17.9 | 11.5 |
| 5 | 18.9 | 11.2 |
| 6 | 17.9 | 11.2 |
| 7 | 20.5 | 7.5 |
| 8 | 26.2 | 4.3 |
| 9 | 13.6 | 3.8 |
| 10 | 15.2 | 5.3 |
| 11 | 22.6 | 7.2 |
| 12 | 22.8 | 7.0 |
| 13 | 24.3 | 6.2 |
| 14 | 16.0 | 11.9 |
| 15 | 15.3 | 4.0 |
| 16 | 21.0 | 3.5 |

TABLE 3-C

| No. | Tensile strength (kg/mm²) | Elongation (%) |
|---|---|---|
| 1 | 15.8 | 14.2 |
| 2 | 15.1 | 16.2 |
| 3 | 19.3 | 8.9 |
| 4 | 18.1 | 11.1 |
| 5 | 19.3 | 11.5 |
| 6 | 17.9 | 10.1 |
| 7 | 20.0 | 7.9 |
| 8 | 30.5 | 6.5 |
| 9 | 16.5 | 16.3 |
| 10 | 18.2 | 16.2 |
| 11 | 22.5 | 7.0 |
| 12 | 22.7 | 6.5 |
| 13 | 24.4 | 6.6 |
| 14 | 15.9 | 12.3 |
| 15 | 21.3 | 6.5 |
| 16 | 20.5 | 3.8 |

Tables 2-A, 2-B, 2-C, 3-A, 3-B and 3-C indicate that the extruded materials obtained from the aluminum alloys of the invention (Nos.1 to 7 and Nos.11 to 14) have substantially uniform strength and elongation independent of extrusion ratio. The aluminum alloys of the invention give sufficient strength and elongation even at a low extrusion ratio of 3.

In contrast, when aluminum alloys containing alloying elements in amounts outside the range of the invention (Nos.8 to 10) cannot achieve desired strength and/or elongation at low extrusion ratio.

EXAMPLE 2

Test pieces (7 mm in diameter and 10.5 mm in length) were prepared from the extruded materials obtained in the same manner as in Example 1.

Upset tests were conducted at 450° C. following the procedures of "Test method for cold upset properties of metals" (tentative standards by Cold Forging Subcommittee of The Japan Society for Technology of Plasticity).

The results are given in Table 4 below as critical reduction (%) of each of test pieces at varying extrusion ratios.

TABLE 4

| Alloy | Critical reduction (%) at varying extrusion ratio | | | |
|---|---|---|---|---|
| | 3 | 5 | 10 | 20 |
| 1 | 65 | 64 | 64 | 64 |
| 2 | 63 | 68 | 68 | 68 |
| 3 | 66 | 65 | 66 | 66 |
| 4 | 60 | 61 | 61 | 61 |
| 5 | 65 | 65 | 64 | 64 |
| 6 | 65 | 66 | 64 | 64 |
| 7 | 63 | 62 | 64 | 64 |
| 8 | 40 | 55 | 65 | 65 |
| 9 | 52 | 66 | 85< | 85< |
| 10 | 44 | 53 | 68 | 68 |
| 11 | 63 | 62 | 61 | 61 |
| 12 | 62 | 63 | 62 | 62 |
| 13 | 60 | 61 | 60 | 60 |
| 14 | 62 | 62 | 61 | 61 |
| 15 | 45 | 51 | 58 | 60 |
| 16 | 53 | 52 | 53 | 53 |

Table 4 shows that extruded materials produced from aluminum alloys of the invention (Nos. 1 to 7 and Nos. 11 to 14) have about 60 to about 70% of critical reduction irrespective of extrusion ratio.

In comparison therewith, the extruded materials produced from comparative aluminum alloys do not exhibit satisfactory forgeability at a low extrusion ratio of 3 to 5.

EXAMPLE 3

An aluminum alloy in a powder form (minus 100 mesh) containing 15% by weight of Si, 5% by weight of Fe and 3% by weight of Ni was cold pressed to a preform 200 mm in diameter (density = 75%) and then extruded at 450° C. at an extrusion ratio of 3 to produce a rod 115 mm in diameter.

The rod was cut to prepare test piece of a length of 175 mm and the test piece was upset forged at 480° C. at an upset reduction of 60%. After the upset forging, the test piece was found to exhibit no cracking and a forged material 175 mm in diameter and 60 mm in height could be produced from the piece.

The same procedures of the above cold pressing, extrusion and upset forging were followed using an aluminum alloy containing 7.5% by weight of Fe, 2% by weight of Cr and 1.5% by weight of Zr (which corresponded to aluminum alloy No.8 of Example 1). However, large cracks were formed at a low upset reduction of less than 10% and the further enlargement of diameter by forging was impossible.

EXAMPLE 4

An aluminum alloy containing 12% by weight of Si, 4% by weight of Fe, 4% by weight of Ni, 2% by weight of Mo and 1.5% by weight of Zr was atomized to prepare a powdery product (minus 100 mesh). The powder was cold pressed to a preform 230 mm in diameter (density = 75%) and the preform was extruded at 450° C. at extrusion ratio of 2.4 to produce a rod 150 mm in diameter.

The rod was cut to a length of 300 mm and dieforged in two stages at 480° C. to obtain a product which had the shape and sizes as shown in FIG. 2.

Although the projected portion of the product (the portion having a diameter of 250 mm) had an upset reduction of about 70%, n cracks were found.

The product shown in FIG. 2 was machined to prepare standard tensile strength test pieces from the portions indicated as (a), (b) and (c).

Table 5 shows tensile strength and elongation of the test pieces at 300° C.

TABLE 5

| Test piece | Tensile strength ($kg/mm^2$) | Elongation (%) |
|---|---|---|
| (a) | 20.5 | 6.3 |
| (b) | 20.7 | 6.4 |
| (c) | 21.6 | 6.0 |

As seen from Table 5, the portion (c) which was worked in the highest degree exhibited higher tensile strength than the portions (a) and (b).

A rotating part machined from the forged product of the invention is especially useful for various devices or equipments operating at high rotating speed since the portion where the highest centrifugal force is exerted has highest strength.

We claim:

1. A process for preparing a large-sized P/M aluminum alloy produce comprising:

extruding, at a temperature between 350 and 500° C. and at an extrusion ratio of 2 to 5, aluminum alloy powder consisting essentially of (a) 5 to 30% by weight of Si, (b) 0.5 to 10% by weight of at least one species selected from the group consisting of Cu, Mg, Fe, Ni, Cr, Mn, Mo, Zr and V with the proviso that the total amount of these species cannot exceed 30% by weight, and (c) aluminum in a remaining amount; and forging the extruded material at a temperature of 400° to 530° C.

2. A process according to claim 1 wherein the aluminum alloy contains 5 to 30% by weight of Si, 3 to 5% by weight of Fe, 3 to 5% by weight of Ni, 0.5 to 2.5% by weight of Mo and 0.5 to 2.5% by weight of Zr.

3. A process for preparing a large-shaped P/M aluminum alloy produce comprising the steps of extruding, at a temperature between 350 and 500° C. and at an extrusion ratio of 2 to 5, aluminum alloy powder consisting essentially of (a) 5 to 30% by weight of Si, (b) 0.5 to 10% by weight of at least one species selected from the group consisting of Cu, Mg, Fe, Ni, Cr, Mn, Mo, Zr and V with the proviso that the total amount of these species cannot exceed 30% by weight, and (c) aluminum in a remaining amount, and die-forging, at a temperature of 400 to 530° C., the extruded material in the radial directions.

4. The process of claim 3, wherein the die-forged product has a shape as shown in FIG. 2, and, when used as a rotating part as shown in FIG. 1, has a relatively higher tensile strength in a direction that coincides with the direction of the highest centrifugal force.

5. A process for preparing a large-sized P/M aluminum alloy product comprising the steps of extruding, at a temperature between 350° and 500° C. and at an extrusion ratio of 2 to 5, aluminum alloy powder consisting essentially of (a) 5 to 30% by weight of Si, (b) 0.5 to 10% by weight of at least one species selected from the group consisting of Cu, Mg, Fe, Ni, Cr, Mn, Mo, Zr and V with the proviso that the total amount of these species cannot exceed 30% by weight, and (c) aluminum in a remaining amount, and upset-forging, at a temperature of 400 to 530° C., the extruded material in the radial directions.

6. The process of claim 5, wherein the upset-forging step is with an upset reduction of 30 to 80%.

7. The process of claim 5, wherein the aluminum alloy contains 5 to 30% by weight of Si, 3 to 5% by weight of Fe, 3 to 5% by weight of Ni, 0.5 to 2.5% by weight of Mo and 0.5 to 2.5% by weight of Zr.

* * * * *